US005886274A

United States Patent [19]

Jungleib

[11] Patent Number: 5,886,274

[45] Date of Patent: Mar. 23, 1999

[54] SYSTEM AND METHOD FOR GENERATING, DISTRIBUTING, STORING AND PERFORMING MUSICAL WORK FILES

[75] Inventor: Stanley Jungleib, Portola Valley, Calif.

[73] Assignee: Seer Systems, Inc., Los Altos, Calif.

[21] Appl. No.: 891,580

[22] Filed: Jul. 11, 1997

[51] Int. Cl.[6] ..... G10H 7/00

[52] U.S. Cl. ..... 84/601

[58] Field of Search ..... 84/601, 645, 604, 84/600; 434/307 A

[56] References Cited

U.S. PATENT DOCUMENTS

| | | | |
|---|---|---|---|
| 5,054,360 | 10/1991 | Lisle et al. | 84/645 |
| 5,119,711 | 6/1992 | Bell et al. | 84/645 X |
| 5,453,570 | 9/1995 | Umeda et al. | 84/645 X |
| 5,484,291 | 1/1996 | Nakai et al. | 84/610 X |
| 5,589,947 | 12/1996 | Sato et al. | 84/645 X |
| 5,728,962 | 3/1998 | Goede . | |
| 5,736,663 | 4/1998 | Aoki et al. . | |
| 5,811,706 | 9/1998 | Van Buskirk et al. | 84/604 |

OTHER PUBLICATIONS

Michael Casey and Paris Smaragdis, "NetSound ICMC96 Paper", Proceedings of the International Computer Music Conference 1996,Hong Kong, reprinted at *http://sound.media.mit.edu/~mkc/icmc96/icmc96.html*.

Jim Aikin, "MIDI Meets the Internet", KeyBoard, Jul. 1997, p. 36.

*Primary Examiner*—William M. Shoop, Jr.
*Assistant Examiner*—Jeffrey W. Donels
*Attorney, Agent, or Firm*—Carr & Ferrell, LLP

[57] ABSTRACT

A composition and playback system includes a sound bank containing at least one instrument sound, an input device for receiving music control signals, a sequencer coupled to the input device for storing the music control signals, and a work manager coupled to the sound bank and to the sequencer for generating a musical work file containing the music control signals and at least a portion of the sound bank. The system further includes a synthesizer engine coupled to the input device for processing the music control signals based on the instrument sounds contained in the sound bank, a mixer coupled to the synthesizer engine for mixing effects with the processed music control signals, and a speaker system coupled to the mixer for converting the mixed music control signals to sound.

45 Claims, 11 Drawing Sheets

SYSTEM AND METHOD FOR GENERATING, DISTRIBUTING, STORING AND PERFORMING MUSICAL WORK FILES

BACKGROUND OF THE INVENTION

1. Field of the Invention

This invention relates generally to Musical Instrument Digital Interface (MIDI) technology, and more particularly to a system and method for generating, distributing, storing and performing musical work files.

2. Description of the Background Art

Music is one of the most popular forms of creative expression. Accordingly, musical system designers have attempted to provide composers with musical tools, such as Musical Instrument Digital Interface (MIDI) technology and General MIDI, for facilitating the creation, distribution, storage and performance of musical works.

MIDI is an international standard that specifies a hardware setup and a software protocol for controlling electronic music instruments. The hardware setup is a serial communications network that runs quickly enough to play very complex music in real time. The software protocol is comprehensive and flexible, and provides a mechanism for encoding basic note playing, performance expression, sound selection and elaborate modes of tape machine and theatrical control. Although MIDI is compact, flexible and lends itself to multimedia applications, traditional MIDI equipment is commonly acknowledged as far too complex for consumers to handle. Further, MIDI compositions are system dependent, and thus, for example, musical information intended by the composer to represent the sounds of a grand piano may be reproduced by a first player system as a bass guitar and by a second player system as a flute.

In response to the complexity and system dependence of MIDI, music system designers created General MIDI which recommends standards and common practices for providing more predictable results and a greater ease of use. Thus, musical information intended by the composer to represent the sounds of a grand piano will be played by all player systems which implement General MIDI as a grand piano. However, because of several critical limitations including a lack of variety, a lack of playing audio samples and poor expressive quality, composers have found General MIDI to be inhibiting.

Therefore, a system and method are needed to provide composers with a musical tool that facilitates generation, distribution, storage and performance of musical information without compromising composer intention, creativity and sound quality.

SUMMARY OF THE INVENTION

The present invention provides a system and method for composing and playing back musical works. The system includes a sound bank containing at least one instrument sound, an input device for receiving music control signals, a sequencer coupled to the input device for storing the music control signals, and a work manager coupled to the sound bank and to the sequencer for generating a musical work file containing the music control signals and at least a portion of the sound bank. The system further includes a synthesizer engine coupled to the input device for processing the music control signals based on the instrument sounds contained in the sound bank, a mixer coupled to the synthesizer engine for mixing effects with the processed music control signals, and a speaker system coupled to the mixer for converting the mixed music control signals to sound.

The method includes the steps of receiving music control signals, receiving at least a portion of a sound bank containing at least one instrument sound, and storing the music control signals and received sound bank portion as a musical work file. The method further includes the steps of processing the music control signals based on the instrument sounds contained in the sound bank, mixing effects with the processed music control signals, and converting the mixed music control signals to sound.

Because, in addition to the MIDI changes, the work manager stores the sound bank to the musical work file, the system and method provide all the information needed to perform the musical piece. Thus, system independence is achieved. That is, unlike systems implementing standard MIDI, the system and method forward data representing the instrument sounds and topology information needed to perform the piece. Unlike systems implementing General MIDI, the system and method enable creation and modification of an infinite variety of custom instrument or non-instrument sounds and thus is not limited to a predetermined set of 128 instruments (plus percussion). Predictable consumer MIDI performance, which was hitherto impossible to achieve, is now rendered certain by this invention.

It will be further appreciated that since the entire system and method is implemented in software, it is possible to maintain any number of channels and any number of tracks, but, of course, limited by processor speed, system bandwidth and memory availability. Thus, the system and method may include an equal number of channels and tracks so that each channel can be stored on a single track.

DETAILED DESCRIPTION OF THE PREFERRED EMBODIMENT

Figure 1:
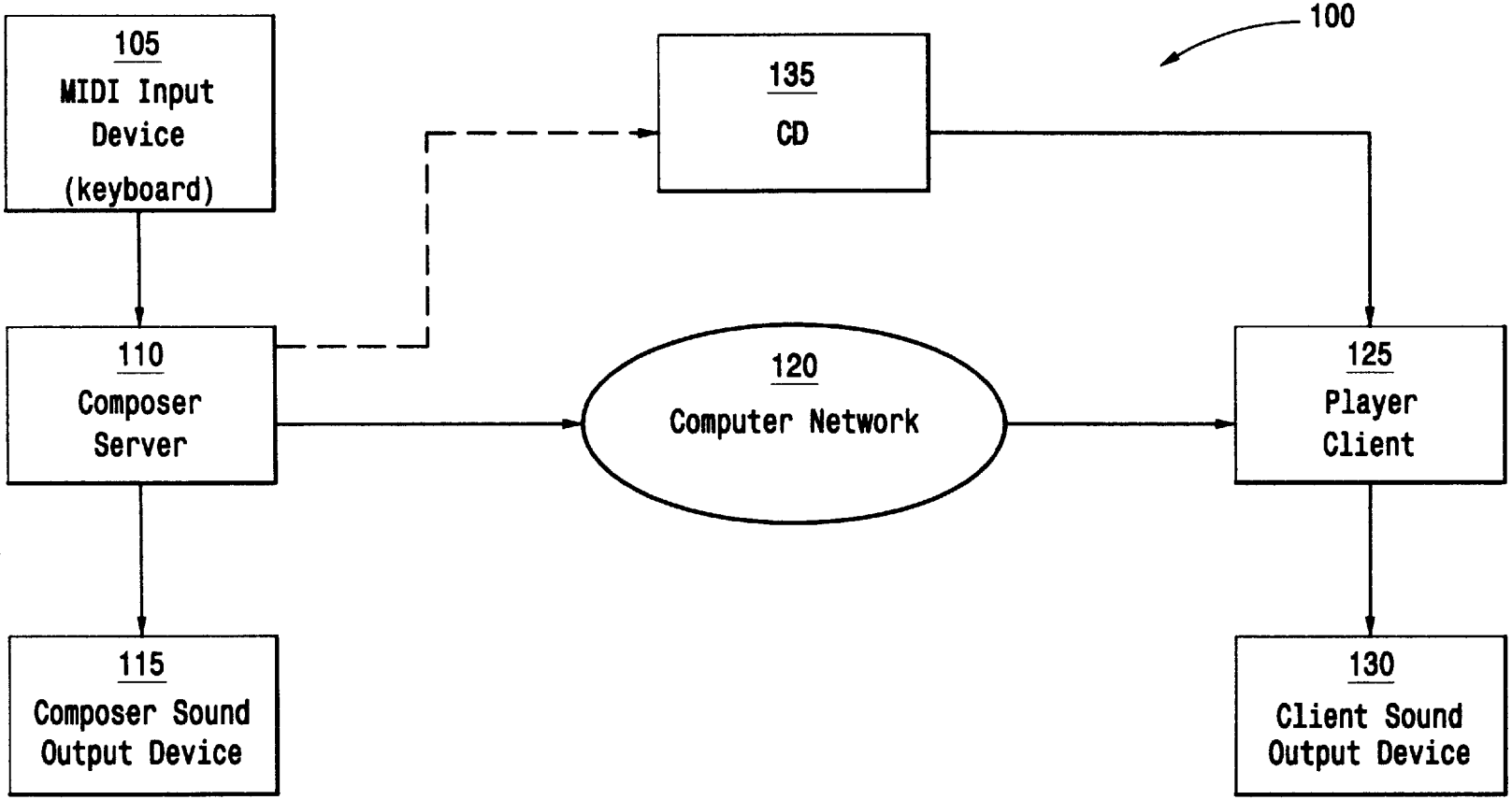
FIG. 1 is a block diagram of a music network system in accordance with the present invention.

FIG. 1 is a block diagram of a music network system 100 in accordance with the present invention. Music network system 100 includes a composer server 110 coupled via a computer network 120 such as the Internet to a player client 125. Composer server 110 receives input control signals representing sound via a Musical Instrument Digital Interface (MIDI) input device 105 such as a conventional synthesizer keyboard, and uses a composer sound output device 115 to convert the control signals to sound. Player client 125 may receive the control signals and other data from composer server 110 via computer network 120 or via a compact disk (CD) 135, and uses a client sound output device 130 to convert the control signals and other data to sound. It will be appreciated that the player client 125 may also be connected to a MIDI input device 105, in which case the player client 125 can be configured to operate as another composer server 110.

Figure 2:
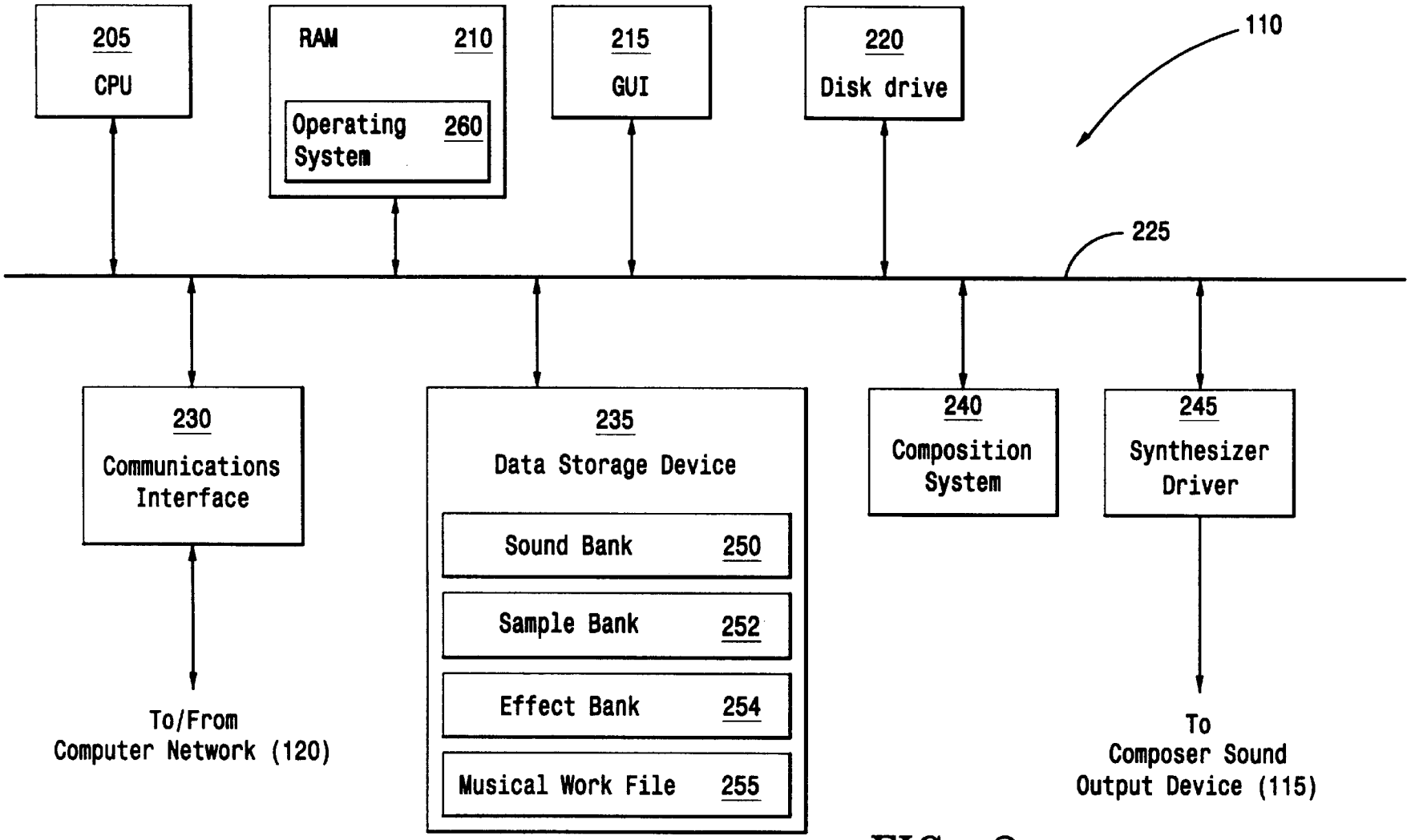
FIG. 2 is a block diagram illustrating details of the composer server of FIG. 1.

FIG. 2 is a block diagram illustrating details of composer server 110 including a Central Processing Unit (CPU) 205, such as an Intel Pentium® microprocessor or a Motorola Power PC® microprocessor, coupled to a signal bus 225. Composer server 110 further comprises a Random Access Memory (RAM) 210, a Graphical User Interface (GUI) 215 which includes input devices such as a keyboard and a mouse and an output device such as a Cathode Ray Tube (CRT) display, and a disk drive 220, each coupled via signal bus 225 to CPU 205. Composer server 110 further includes a communications interface 230 coupled between signal bus 225 and computer network 120 (FIG. 1), and a data storage device 235 such as a magnetic disk coupled to signal bus 225.

An operating system 260 includes a program that controls processing by CPU 205, and is typically stored in data storage device 235 and loaded into RAM 210 for execution. A composition system 240 contains programs for creating synthesizer files such as a sound bank 250, a sample bank 252 and an effect bank 254, programs for using the synthesizer files to generate music sequences, programs for synthesizing music from the sequences, and programs for generating an integral musical work file 255 to be forwarded to the player client 125. Composition system 240 also may be stored in data storage device 235 and loaded into RAM 210 for execution by CPU 205.

Sound bank 250 is a data file containing at least the instrument sounds needed by the composer, and is typically stored in data storage device 235 but may be stored at some predetermined location in computer network 120. Sample bank 252 is a data file containing audio clips of specific sounds such as a dog's bark, a cat's meow, a water drop, etc., and may be stored in data storage device 235 or at some predetermined location in computer network 120. Effect bank 254 is a data file containing effect algorithms and effect parameters for creating musical effects such as reverberation, chorus, etc., and may also be stored in data storage device 235 or at some predetermined location in computer network 120. A synthesizer driver 245 is a program for controlling performance of the musical sequence on composer sound output device 115 (FIG. 1), and also may be stored in data storage device 235 and loaded into RAM 210 for execution by CPU 205.

Figure 3:
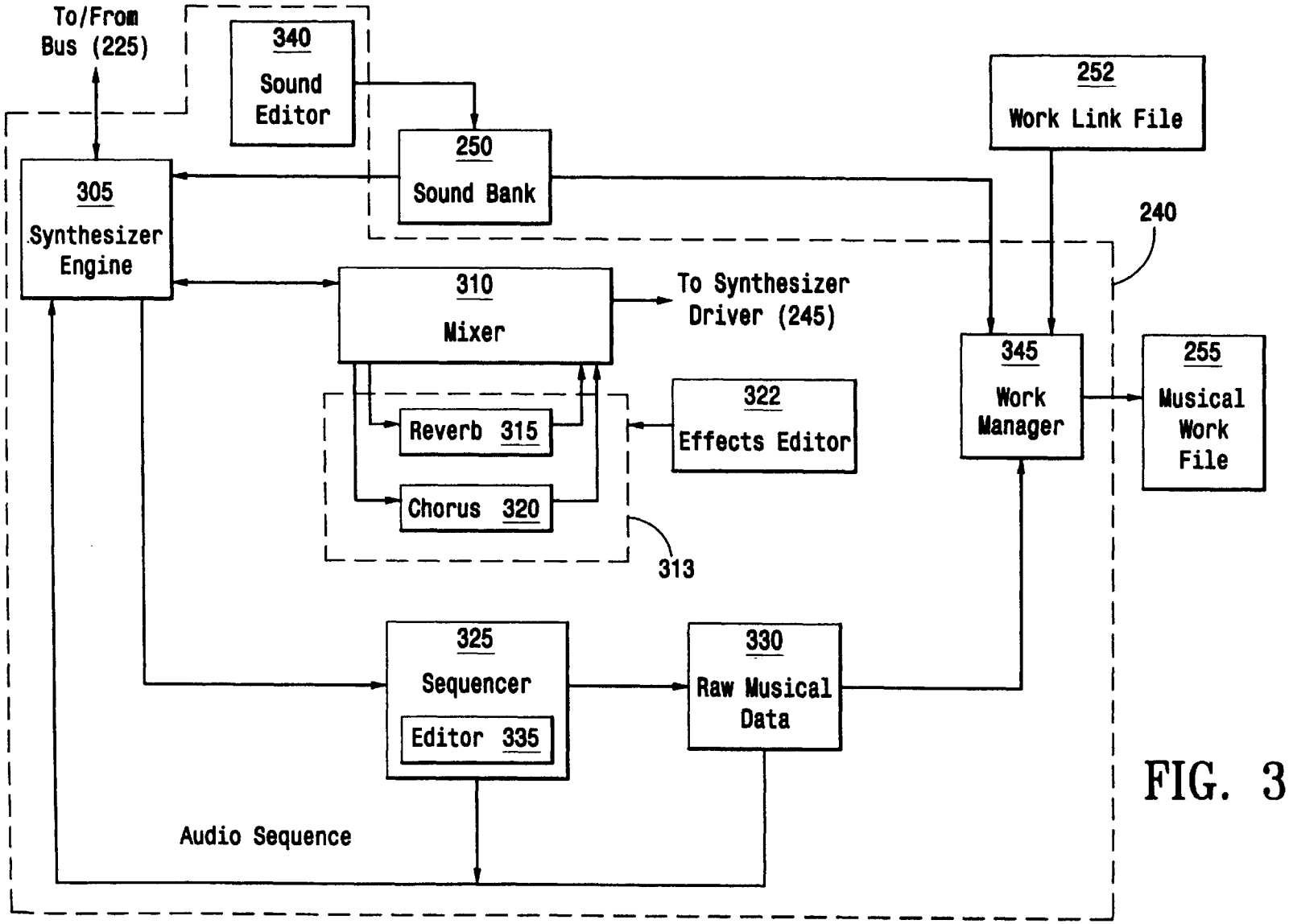
FIG. 3 is a block diagram illustrating details of the composition system of FIG. 2.

FIG. 3 is a block diagram illustrating details of composition system 240, which includes a synthesizer engine 305 coupled to signal bus 225 (FIG. 2) for processing input control signals from input device 105. These input control signals may include instrument sound selections, music sequence data, initial topology such as initial mix and effect parameters, and topology changes such as mix and effect parameter changes.

Synthesizer engine 305 via sequencer 325 converts the input control signals or sequence control signals to a raw musical data 330 audio sequence. Synthesizer engine 305 processes the raw musical data 330 audio sequence based on the composer's instrument sound selections, and delivers the processed sequence to mixer 310. Mixer 310 uses the initial topology information to configure mixer 310 and the musical effects 313 such as reverb 315 and chorus 320. Example mix variables for a stereo mixer 310 include synthesizer volume, synthesizer pan, audio volume, audio pan, audio reverb send, audio chorus send, reverb return level, reverb return balance, chorus return level, chorus return balance, etc. It will be appreciated that the characteristics of reverb 315 and chorus 320 are defined by the effect algorithms contained in effect bank 254, which may be created or edited by an effects editor 322. The composer via MIDI input device 105 may modify the effect parameters to modify the effects 313. Mixer 310 then mixes the effects 313 into the processed raw musical data 330 audio sequence, and forwards the mix to synthesizer driver 245 for conversion to sound.

Synthesizer engine 305 also forwards to sequencer 325 the input control signals representing the MIDI-based musical sequences and topology changes created by a composer. Sequencer 325 compiles and stores the signals in a predetermined time-based format as raw musical data 330, which may be stored in data storage device 235 or on a compact disk 135. Sequencer 325 preferably includes a sequencer editor 335 for enabling modifications such as cut, paste, repeat, modify instrument sound selection, change pitch, change topology, etc. of stored raw musical data 330. Synthesizer engine 305 can retrieve the modified raw musical data 330 for conversion via mixer 310 to sound.

Input control signals may also include work links, which reference work link data such as previously created sounds, effects, samples, etc. Work link data may be stored at locations anywhere in network system 100. Accordingly, to incorporate instrument sounds, synthesizer engine 305 retrieves the composer-selected instruments sounds either from local sound bank 250 or from the locations in system 100 referenced by work links. Similarly, to incorporate samples, the synthesizer engine 305 retrieves the samples either from the local sample bank 252 or from the locations in system 100 referenced by work links. To incorporate effects, the synthesizer engine 305 retrieves the effects either from local effect bank 254 or from the locations in system 100 referenced by work links. Synthesizer engine 305 temporarily stores work linked sounds into sound bank 250, work linked effects into effect bank 254 and work linked samples into sample bank 252 for easy and efficient playback.

Composition system 240 further includes a sound editor 340 coupled to sound bank 250 for enabling a composer to add instrument sounds to, delete instrument sounds from or modify instrument sounds contained in sound bank 250. Creating and modifying instrument sounds may be implemented by processing sounds synthetically, by digitally modifying a sound sample or by a combined method. Sound editor 340 is described in greater detail with reference to FIGS. 4*a*, 4*b*, 4*c* and 4*d*.

Composition system 240 also includes a work manager 345 which reformats, imports and exports sound bank 250, sample bank 252, effect bank 254 and raw musical data 330 into a predetermined file format, and stores the re-formatted data to a musical work file 255. Work manager 345 further maintains file legitimacy, allows real-time edit buffering and file maintenance, and in general allows updated industry standard tools to export their data into the present system 100 without the responsibility of maintaining the integrity of musical work file 255. Work manager 345 is described in greater detail with reference to FIG. 5.

Because, in addition to the raw musical data 330, musical work file 255 includes sound bank 250, sample bank 252 and effect bank 254, musical system 100 provides all the information needed to perform the musical piece. Thus, system independence is achieved. That is, unlike systems implementing standard MIDI, composition system 240 forwards data representing the instrument sounds and topology information needed to perform the piece. Unlike systems implementing General MIDI, composition system 240 enables creation and modification of an infinite variety of custom instrument or non-instrument sounds and thus is not limited to a predetermined set of 128 instruments (plus percussion). Predictable consumer MIDI performance, which was hitherto impossible to achieve, is now rendered certain by this invention.

It will be further appreciated that since the entire composition system 240 is implemented in software, it is possible to maintain any number of channels and any number of tracks, but, of course, limited by processor speed, system bandwidth and memory availability. In the preferred embodiment, composition system 240 includes an equal number of channels and tracks so that each channel can be stored on a single track. For example, composition system 240 may manage 1024 channels and 1024 tracks.

Figure 4A:
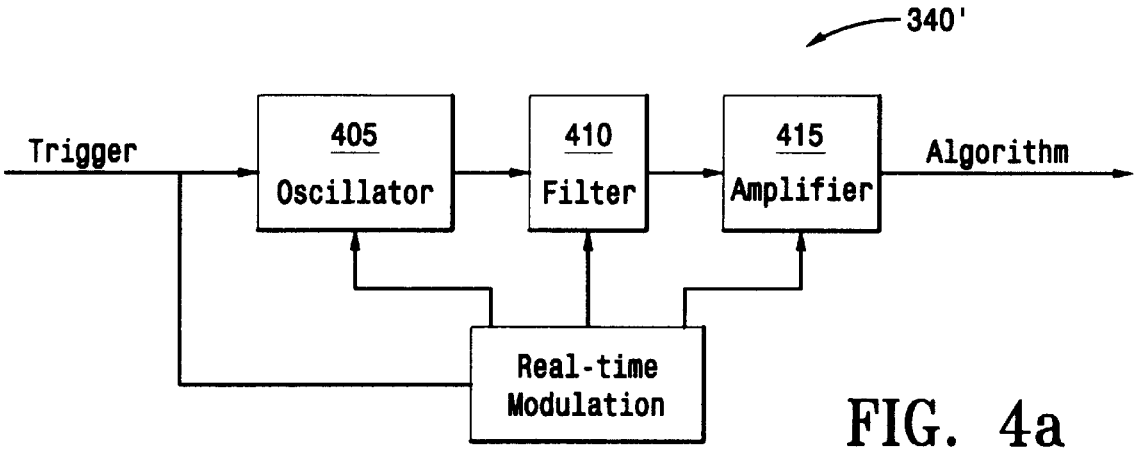
FIG. 4*a* illustrates a sound editor for a synthetic voice.
Figure 4B:
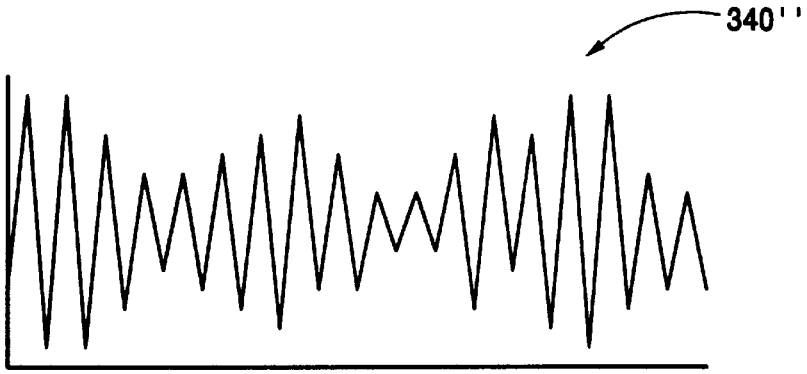
FIG. 4*b* illustrates a waveform generated by a digital sound editor which uses Pulse Code Modulation (PCM) techniques.
Figure 4C:
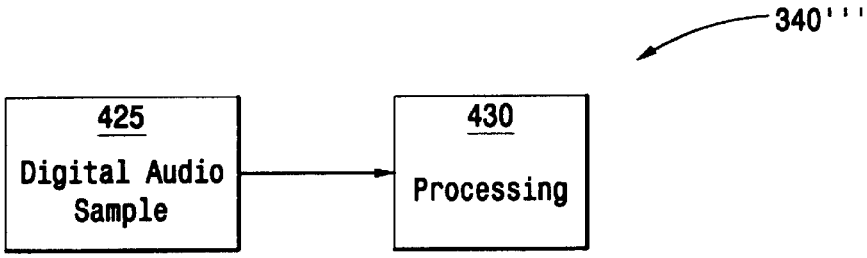
FIG. 4*c* illustrates a combined sound editor.
Figure 4D:
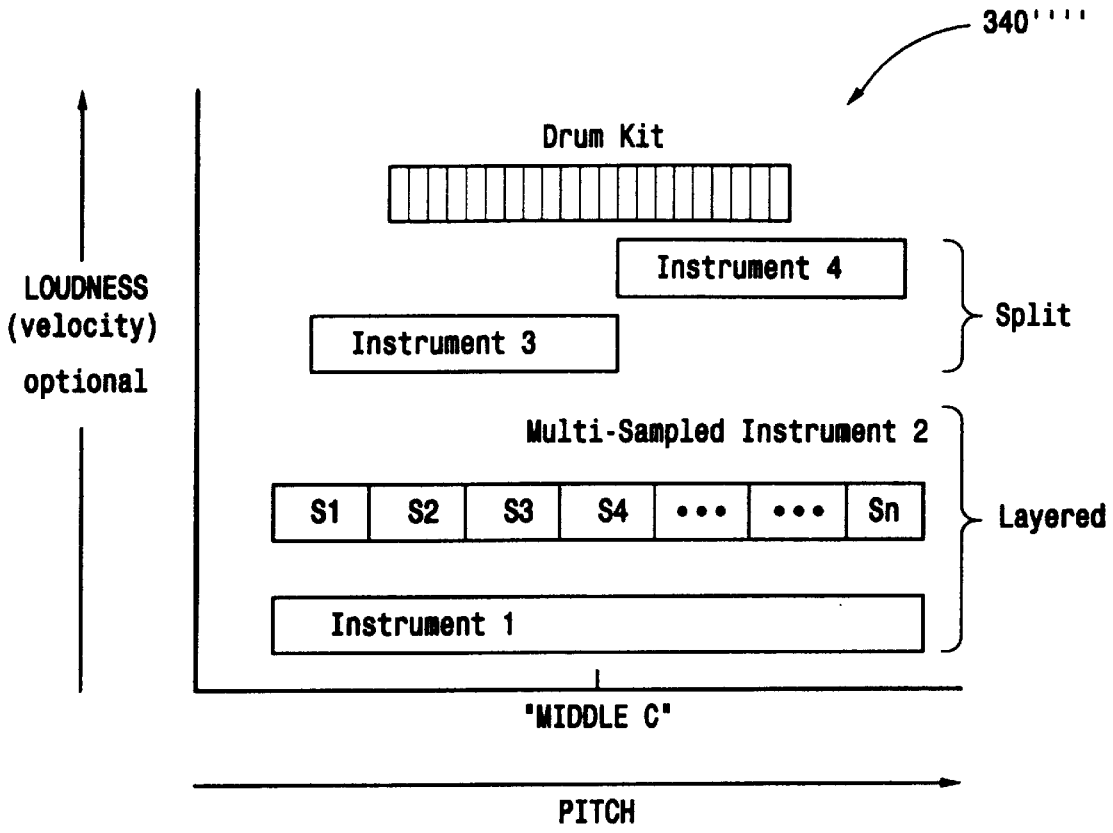
FIG. 4*d* illustrates a sound editor user interface.

FIGS. 4*a*, 4*b*, 4*c* and 4*d* illustrate four alternative types of sound editors 340. Namely, FIG. 4*a* illustrates a sound editor 340' for generating a synthetic voice. Sound editor 340' includes an oscillator 405 for receiving a trigger and responsively generating a sound signal, a filter 410 coupled to oscillator 405 for modifying the sound signal, and an amplifier 415 coupled to filter 410 for controlling the sound signal. Sound editor 340' further includes a real-time modulation block 420 coupled to oscillator 405, filter 410 and amplifier 415 for receiving the trigger signal and animating the behavior of oscillator 405, filter 410 and amplifier 415. FIG. 4*b* illustrates a waveform captured by a digital sound editor 340" which uses Pulse Code Modulation (PCM) techniques to convert the analog sample to a digital signal. FIG. 4*c* illustrates a combined sound editor 340''' topology which includes a digital audio sample 425 coupled to a processing block 430 for synthetically modifying digital audio sample 425. FIG. 4*d* shows a sound editor user interface 340'''' used to combine individual sounds into practical and expressive instruments. In addition to arranging instruments arbitrarily in the space of loudness and pitch, these editors typically provide further parameterization of each instrument for volume, pan, transposition, delay and effects processing at a global level.

Figure 5:
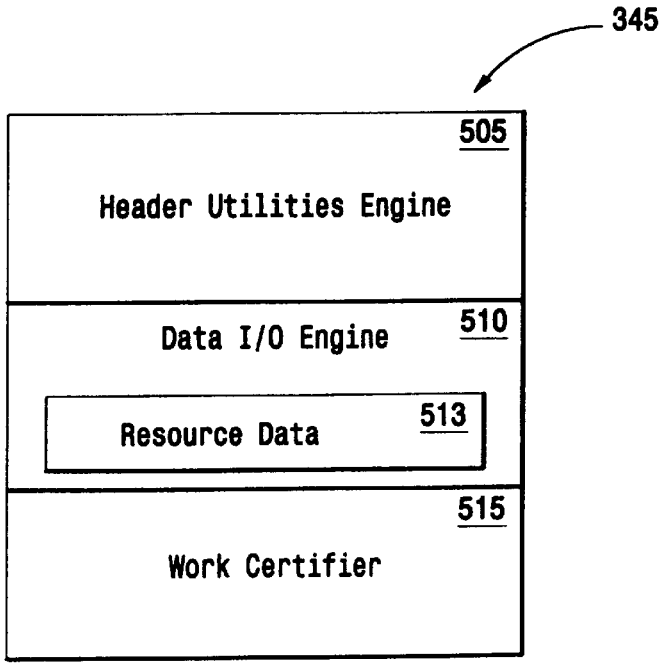
FIG. 5 is a block diagram illustrating details of the work manager of FIG. 3.

FIG. 5 is a block diagram illustrating details of work manager 345, which includes a header utilities engine 505, a data Input/Output (I/O) engine 510 and a work certifier 515.

Header utilities engine 505 assigns and stores in musical work file 255 header data including musical work file identification (ID) information such as a work file name, the composer's name, a serial number, a composition system 240 version number, etc. Header utilities engine 505 may also compute and store in musical work file 255 the number of channels needed by player client 125 to perform the musical work.

Data I/O engine 510 retrieves, reformats and stores sound bank 250, sample bank 252, effect bank 254 and raw musical data 330 into musical work file 255. Data I/O engine 510 may also use resource data 513 to compute and store initialization data indicating initial channel parameters, an approximation of the time needed to download sounds from sound bank 250, and a sequential list of topology changes needed during performance of the musical work.

Work certifier 515 checks for data integrity and authenticates musical work file 255 by, for example, stamping the file 255 with a certificate, password key or encryption key. Thus, a composer server 110 may authenticate the musical work file 255 and only an authorized player client 125 may perform the work.

Figure 6:
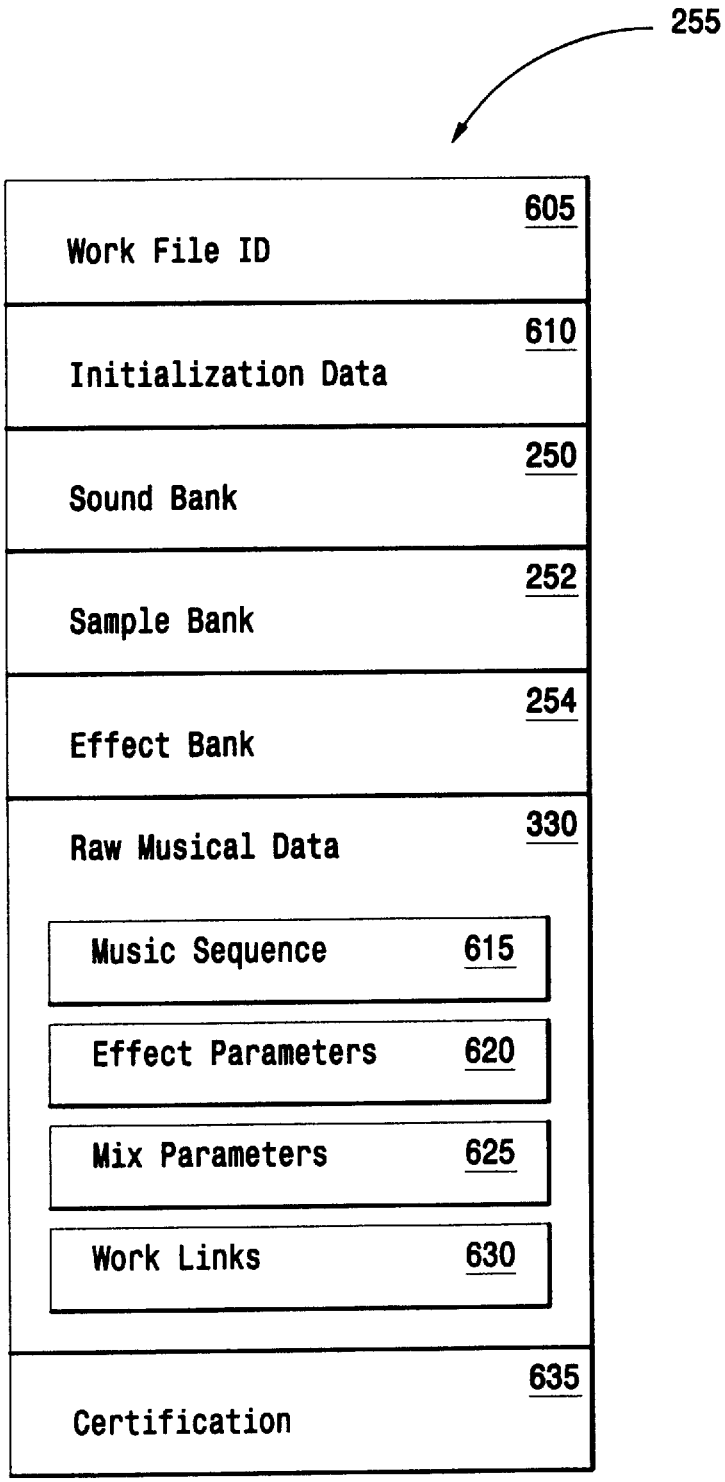
FIG. 6 illustrates an example musical work file.

FIG. 6 illustrates an example musical work file 255, which includes work file ID 605, initialization data 610, a copy of sound bank 250, a copy of sample bank 252, a copy of effect bank 254, a copy of raw musical data 330 and certification 635. Raw musical data 330 includes the music sequence 615, the effect parameter changes 620, the mix parameter changes 625 and work links 630. Although in this embodiment a copy of the work link data referenced by work links 630 is not included as part of musical work file 255, an equivalent embodiment may include the copy. In this embodiment, player client 125 may download the needed work link data in real time from its source, e.g., from composer server 110 or from computer network 120. It will be appreciated that the different tracks and thus the different channels may be stored separately as raw musical data 330.

Figure 7:
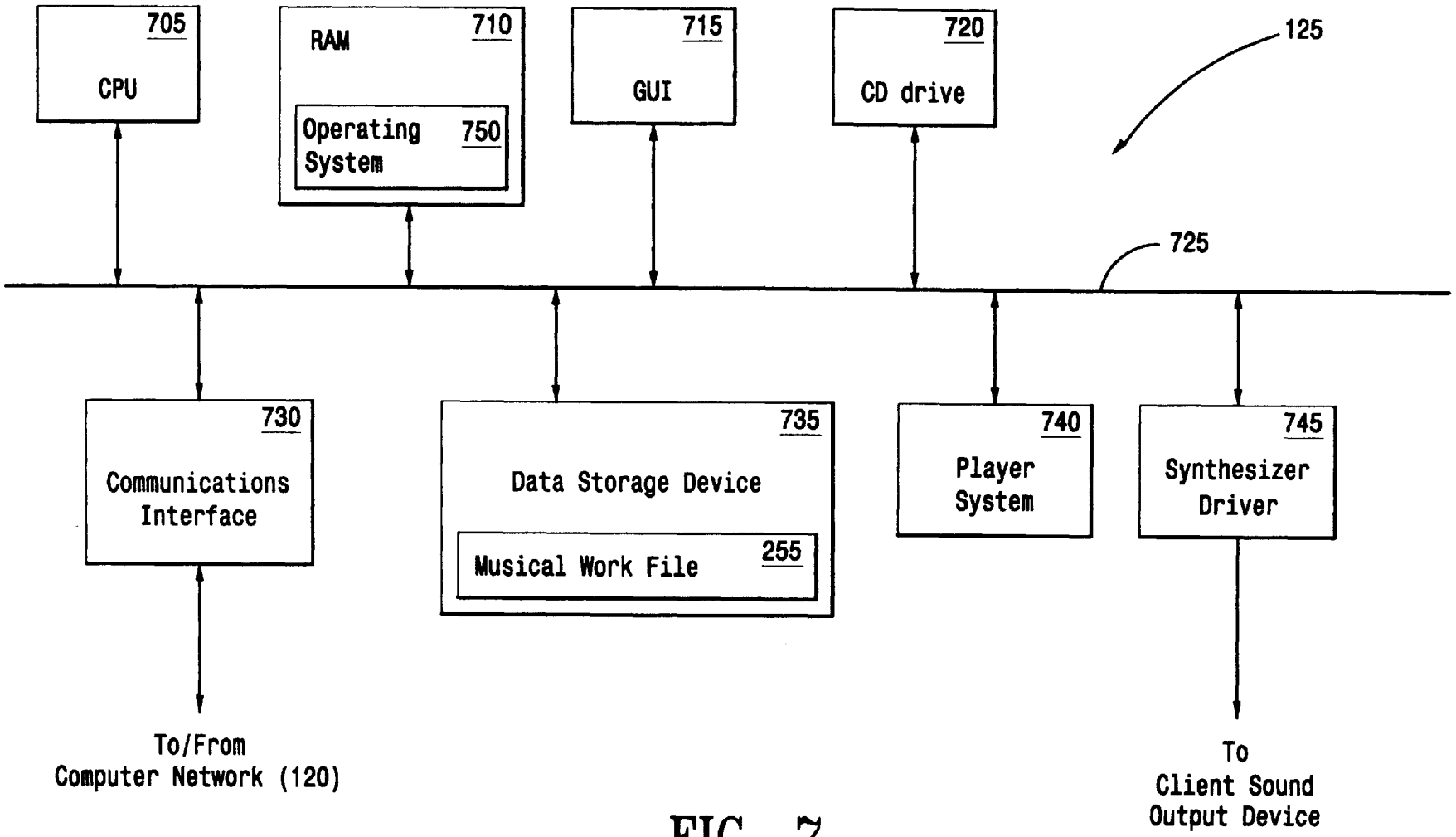
FIG. 7 is a block diagram illustrating details of the player client of FIG. 1.

FIG. 7 is a block diagram illustrating details of player client 125 which includes a CPU 705, such as an Intel Pentium® microprocessor or a Motorola Power PC® microprocessor, coupled to a signal bus 725. Player client 125 further comprises RAM 710, a GUI 715 which includes input devices such as a keyboard and mouse and an output device such as a Cathode Ray Tube (CRT) display, and a CD drive 720, each coupled via signal bus 725 to CPU 705. Player client 125 further includes a communications interface 730 coupled between signal bus 725 and computer network 120 (FIG. 1), and a data storage device 735 such as a magnetic disk coupled to signal bus 725.

An operating system 750 is a program that controls processing by CPU 705, and is typically stored in data storage device 735 and loaded into RAM 710 for execution. A player system 740 includes programs for decoding musical work file 255, programs for setting the topology and programs for controlling the performance of the musical work. Player system 740 may be stored in data storage device 735 and loaded into RAM 710 for execution by CPU 705. Upon receipt, musical work file 255 may be stored in data storage device 735 and loaded into RAM for easy access by player system 740. Player system 740 is described in greater detail with reference to FIG. 8. A synthesizer driver 745 is a program for controlling client sound output device 130 (FIG. 1), and is also typically stored in data storage device 735 and loaded into RAM 710 for execution by CPU 705.

Figure 8:
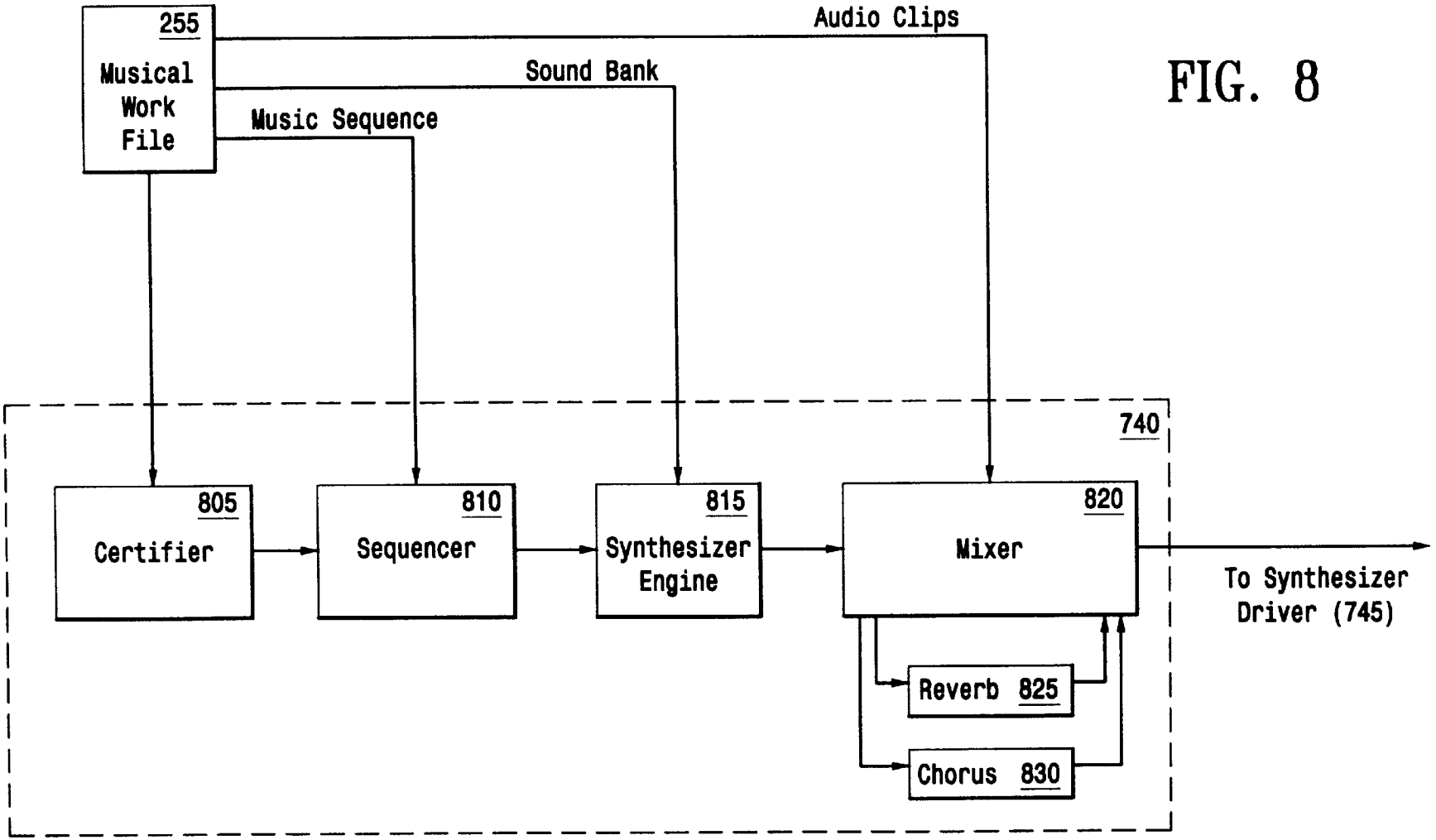
FIG. 8 is a block diagram illustrating details of the player system of FIG. 7.

FIG. 8 is a block diagram illustrating player system 740, which includes a certifier 805 for examining certification 640 to authenticate musical work file 255 and to determine the rights of player client 125 to perform musical work file 255. The certifier 805 also enables gathering needed work link data which is referenced by work links contained in raw musical data 330. Player system 740 includes a sequencer 810 coupled to certifier 805 for playing the raw musical data 330 contained in musical work file 255.

Player system 740 includes a synthesizer engine 815 coupled to sequencer 810 for adding instrument sounds to the music sequence 615 by retrieving the composer-selected instrument sounds from sound bank 250 contained in musical work file 255 or from the locations referenced by the work links 630. Player system 740 further includes, coupled between synthesizer engine 815 and synthesizer driver 745, a mixer 820 configured according to mix parameters 625; and includes musical effects including reverb 825 and chorus 830 coupled to mixer 820 which are configured according to algorithms in effect bank 254 and corresponding effect parameters 620. Mixer 820 mixes the music sequence 615 and the effects. It will be appreciated that player system 740 operates in conjunction with operating system 750 (for example, various versions of Windows by Microsoft Corporation) for loading and unloading sounds from data storage device 235.

Figure 9:
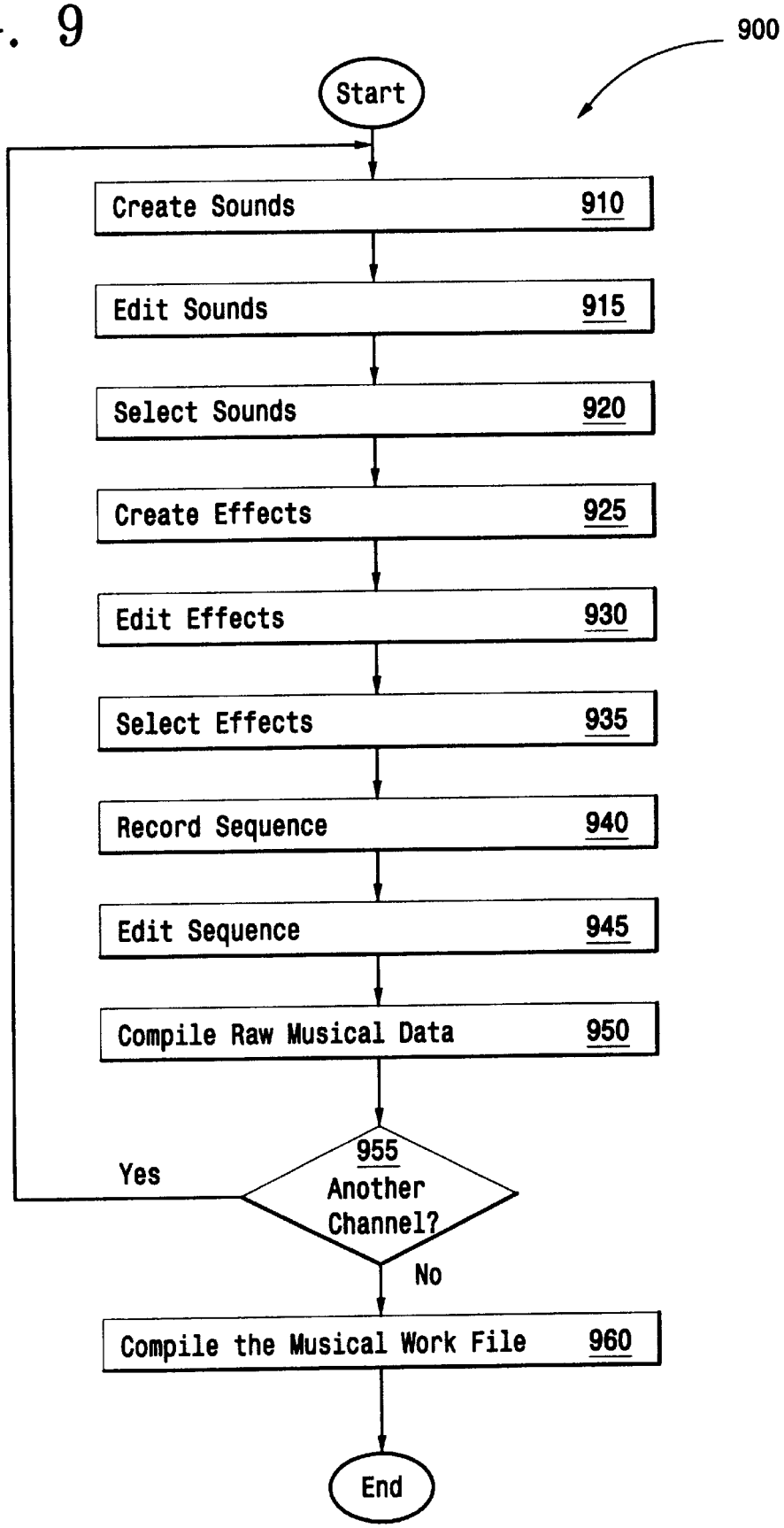
FIG. 9 is a flowchart illustrating a method for composing a musical work.

FIG. 9 is a flowchart illustrating a preferred method 900 for composing a musical work. Method 900 begins with step 910 by sound editor 340 enabling creation of sounds for storage in sound bank 250. Sound editor 340 in step 915 enables modification of sounds stored in sound bank 250, possibly to create new sounds. The composer via MIDI input device 105 in step 920 selects sounds for the instruments to be played on a first channel by player client 125. Step 920 may include selecting one of the sounds from sound bank 250, or selecting a previously created sound from a location somewhere within network 120 and adding a work link 630 to reference that location. It will be appreciated that step 920 may further include selecting a fall-back sound, such as one of GM sounds 1–128, to use if the custom sound is unavailable at the start of the sequence.

Effects editor 322 in step 925 may be used to create effects for storage in effect bank 254, and in step 930 enables modification of the effects stored in effect bank 254 possibly to create new effects. The composer via MIDI input device 105 in step 935 selects the effects to be used by player client 125 on the first channel. Step 925 may include selecting one of the effects from effect bank 254, or selecting a previously created effect from a location somewhere within network 120 and adding a work link 630 to reference that location.

Sequencer 325 in step 940 records a music sequence including topology changes as part of raw musical data 330 to be used on the first channel. Step 940 includes receiving other input control signals such as intonation and expression information from MIDI input device 105 and passing the signals through synthesizer engine 305 to sequencer 325 for storage. Sequencer editor 335 in step 945 enables the composer to edit raw musical data 330, e.g., to edit the music sequences, to edit pitches, to edit effects, to copy, to paste, etc.

Sequencer 325 in step 950 retains the music sequence data 615 including the composer-selected instrument sounds, the performance, the mixer and effect changes, etc. as raw musical data 330. In step 955, a determination is made whether to record musical data to another channel. If so, then method 900 returns to step 910. Otherwise, work manager 345 compiles sound bank 250, sample bank 252, effect bank 254 and all channels of raw musical data 330 into a musical work file 255. Step 960 is described in greater detail with reference to FIG. 10. Method 900 then ends.

Figure 10:
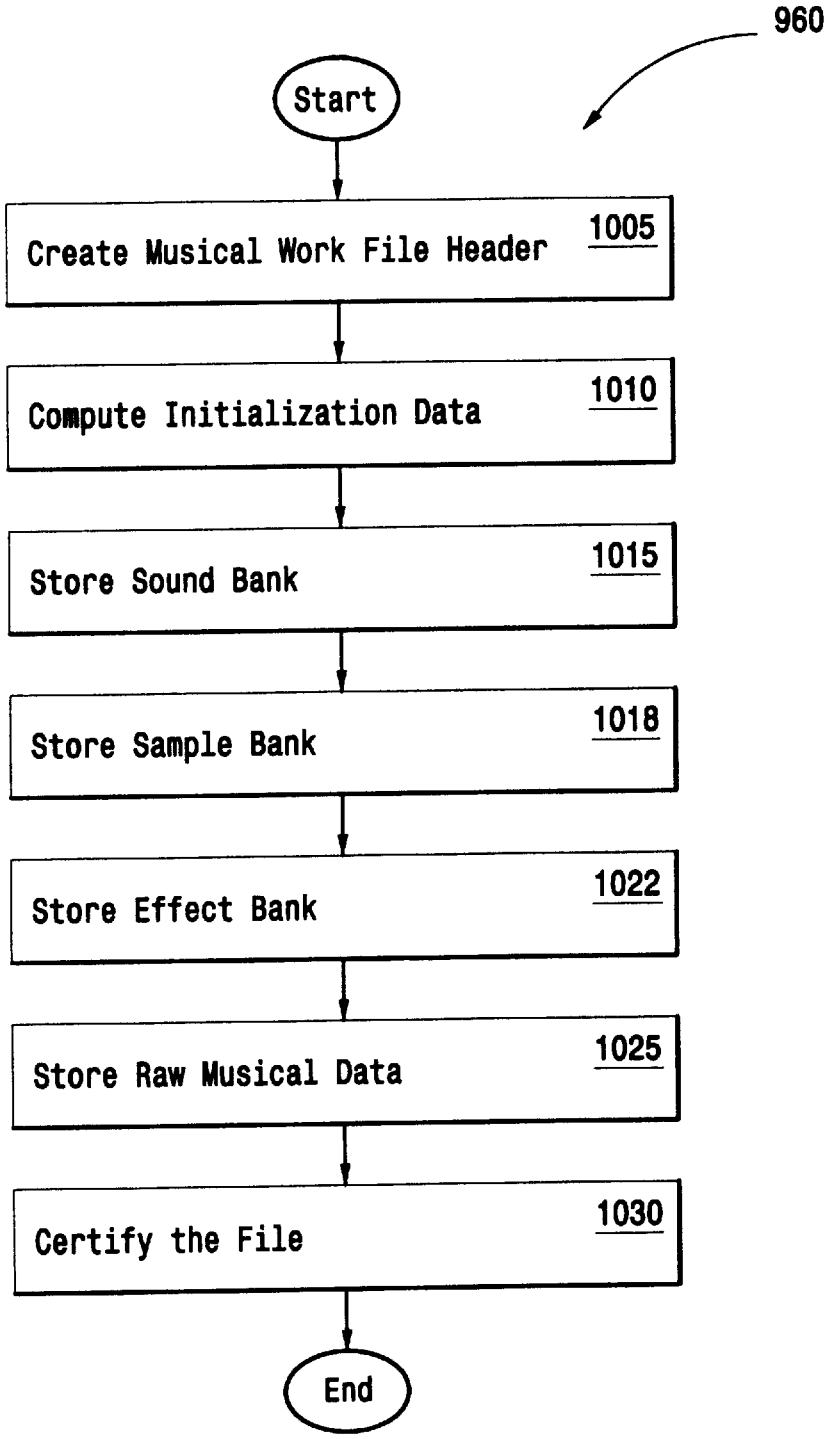
FIG. 10 is a flowchart illustrating details of the FIG. 9 step of compiling the musical work file.

FIG. 10 is a flowchart illustrating details of step 960 (FIG. 9), which begins by header utilities engine 505 in step 1005 creating and storing to musical work file 255 a work file ID for identifying the musical work. Data I/O engine 510 in step 1010 uses resource data 513 and raw musical data 330 to compute initialization data 610 representing the initial state of the music sequence as created by the composer, and stores the initialization data 610 to musical work file 255. Initialization data 610 includes the initial topology parameters. The data I/O engine 510 retrieves and stores in step 1015 the sound bank 250, in step 1018 the sample bank 252 and in step 1022 the effect bank 254 to musical work file 255. The data I/O engine 510 in step 1025 retrieves and stores raw musical data 330, which includes music sequence 615, effect parameter changes 620, mix parameter changes 625 and work links 630 for all channels, to musical work file 255. In step 1030, work certifier 520 adds certification 640 to musical work file 255 so that player client 125 can authenticate and verify right to perform musical work file 255. Step 960 then ends.

Figure 11:
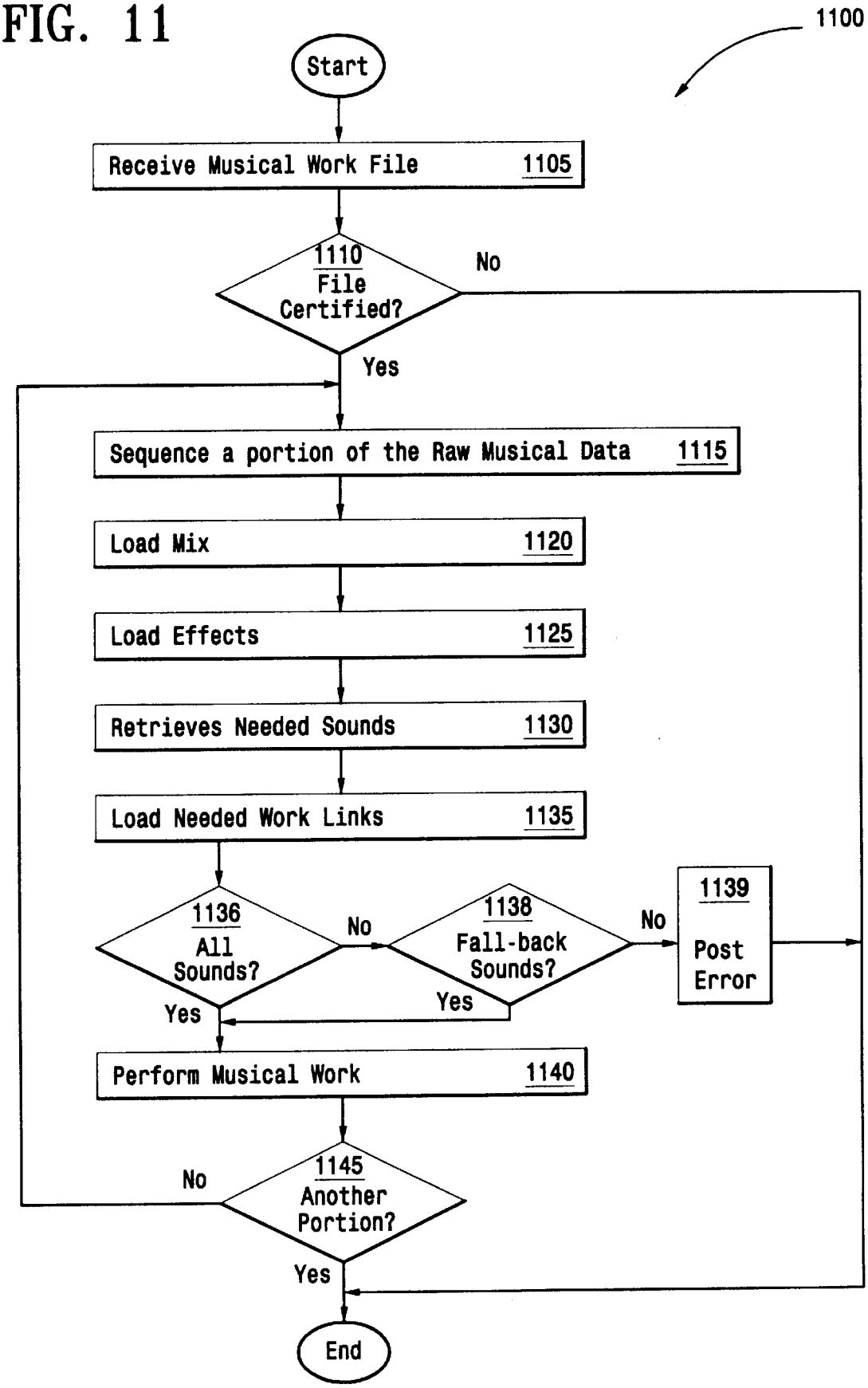
FIG. 11 is a flowchart illustrating a method for performing a channel of the musical work file.

FIG. 11 is a flowchart illustrating a method 1100 for performing a channel of musical work file 255. Method 1100 begins with step 1105 by communications interface 730 or CD drive 720 of player client 125 receiving musical work file 255. Certifier 805 in step 1110 examines certification 640 to determine whether player client 125 is certified to perform the musical work file 255. If not, then method 1100 ends. Otherwise, certifier 805 forwards at least a portion of a first channel contained in musical work file 255 to sequencer 810, which in step 1115 forwards the corresponding channel portion to synthesizer engine 815.

For the first channel portion, synthesizer engine 815 in step 1120 downloads the composer-selected initial mix parameters 625 from raw musical data 330 of musical work file 255 to mixer 820, and in step 1125 downloads the composer-selected initial effect parameters 620 from raw musical data 330 of musical work file 255 to the selected effects. Synthesizer 815 in step 1130 retrieves from sound bank 250 the instrument sounds referenced by the music sequence 615, and in step 1135 downloads any instruments, mixes, effects or other work link data from the locations specified by work links 630.

Synthesizer engine 815 in step 1136 determines whether all sounds needed to perform the musical work are available. If so, then method 1100 proceeds to step 1140. If a custom sound is unavailable, synthesizer engine 1136 determines whether a fall-back sound such as a GM sound is available to replace it. If not, then synthesizer engine in step 1139 posts an error message and method 1100 then ends. Otherwise, method 1100 references the available fall-back sounds and proceeds to step 1140.

In step 1140, synthesizer 815 synthesizes and forwards the corresponding channel portion to synthesizer driver 745, which in conjunction with client sound output device 130 (FIG. 1) converts the synthesized channel portion to sound. In step 1145, sequencer 810 determines whether musical work file 255 includes another channel portion to be performed. If so, then method 1100 returns to step 1115. Otherwise, method 1100 ends.

The foregoing description of the preferred embodiments of the invention is by way of example only, and other variations of the above-described embodiments and methods are provided by the present invention. Components of this invention may be implemented using a programmed general purpose digital computer, using application specific integrated circuits, or using a network of interconnected conventional components and circuits. The embodiments described herein have been presented for purposes of illustration and are not intended to be exhaustive or limiting. Many variations and modifications are possible in light of the foregoing teaching. The system is limited only by the following claims.

What is claimed is:

1. A composition system comprising:

a sound bank containing at least one instrument sound;

an input device for receiving music control signals;

a sequencer coupled to the input device for storing the music control signals; and a work manager coupled to the sound bank and to the sequencer for generating a musical work file containing the music control signals and at least a portion of the sound bank.

2. The composition system of claim 1 further comprising a sound editor for modifying the sound bank.

3. The composition system of claim 2 wherein modifying the sound bank includes adding instrument sounds to, deleting an instrument sound from and modifying an instrument sound contained in the sound bank.

4. The composition system of claim 1 wherein the input device is a MIDI input device.

5. The composition system of claim 4 wherein the input device is a computer keyboard.

6. The composition system of claim 1 wherein the work manager includes a header utilities engine for generating a header to the musical work file.

7. The composition system of claim 6 wherein the header includes a title, a serial number, and a composer's name.

8. The composition system of claim 1 wherein the work manager includes a work certifier for certifying the musical work file.

9. The composition system of claim 1 wherein the work manager includes a data I/O engine for storing the at least a portion of the sound bank and the music control signals into the musical work file.

10. The composition system of claim 9 wherein the music control signals include a work link, and the data I/O engine further stores the work link to the musical work file.

11. The composition system of claim 9 wherein the music control signals include a music sequence, mix changes and effect changes; and the data I/O engine further stores the music sequence, the mix changes and effect changes to the musical work file.

12. The composition system of claim 11, further comprising an effect bank storing effect and mix algorithms; and wherein the data I/O engine stores the effect bank to the music work file.

13. The composition system of claim 1, further comprising a sample bank; and wherein the work manager stores the sample bank to the music work file.

14. The composition system of claim 1 further comprising a synthesizer engine coupled to the input device for processing the music control signals based on the instrument sounds contained in the sound bank;

a mixer coupled to the synthesizer engine for mixing effects with the processed music control signals; and a speaker system coupled to the mixer for converting the mixed music control signals to sound.

15. The composition system of claim 14 wherein the music control signals include a work link specifying a location storing work link data;

the data I/O engine further stores the work link to the musical work file; and the synthesizer engine retrieves the work link data stored at the location specified by the work link.

16. A method comprising the steps of:

receiving music control signals;

receiving at least a portion of a sound bank containing at least one instrument sound; and storing the music control signals and received sound bank portion as a musical work file.

17. The method of claim 16 further comprising the step of modifying the sound bank.

18. The method of claim 17 wherein the step of modifying the sound bank includes adding instrument sounds to, deleting an instrument sound from and modifying an instrument sound contained in the sound bank.

19. The method of claim 16 wherein the step of receiving music control signals is achieved using a MIDI keyboard.

20. The method of claim 16 further comprising the step of generating a header to the musical work file.

21. The method of claim 20 wherein the header includes a title, a serial number, and a composer's name.

22. The method of claim 16 further comprising the step of certifying the musical work file.

23. The method of claim 22 wherein the music control signals include a music sequence, mix changes and effect changes, and further including the step of storing the music sequence, the mix changes and the effect changes to the musical work file.

24. The method of claim 23 wherein the music control signals include a work link, and further including the step of storing the work link to the musical work file.

25. The method of claim 16 further comprising the steps of processing the music control signals based on the instrument sounds contained in the sound bank;

mixing effects with the processed music control signals; and converting the mixed music control signals to sound.

26. A composition system comprising:

means for receiving music control signals;

means for receiving at least a portion of a sound bank containing at least one instrument sound; and means for storing the music control signals and received sound bank portion as a musical work file.

27. A computer-readable medium storing program code for causing a computer to perform the steps of:

receiving music control signals;

receiving at least a portion of a sound bank containing at least one instrument sound; and storing the music control signals and received sound bank portion as a musical work file.

28. A player system that can receive and play downloadable-in-real-time musical data, comprising:

an input terminal for receiving a musical work file containing downloadable-in-real-time topology information, downloadable-in-real-time music sequence data, and a sound bank which includes at least one downloadable-in-real-time instrument sound;

a synthesizer capable of adding downloadable-in-real-time sounds, said synthesizer being coupled to the input terminal for processing the music sequence data based on the topology information and the sound bank; and a speaker system coupled to the synthesizer for converting the processed music sequence data to sound.

29. The player system of claim 28 wherein the input terminal includes a CD drive.

30. The player system of claim 28 wherein the input terminal includes a network communications interface.

31. The player system of claim 28 further comprising a mixer for mixing effects with the processed music sequence data.

32. The player system of claim 31 wherein the topology information includes initial effect parameters for controlling the effects.

33. The player system of claim 31 wherein the topology information further includes initial mix parameters for controlling the mixer.

34. The player system of claim 31 wherein the music sequence data includes a work link specifying a location storing work link data; and the synthesizer engine retrieves the work link data referenced by the work link.

35. The player system of claim 28 further comprising a certifier for certifying rights of the player system to convert the processed music sequence to sound.

36. A method for playing a musical work file comprising the steps of:

receiving said musical work file containing downloadable-in-real-time topology information, downloadable-in-real-time music sequence data, and a sound bank which includes at least one downloadable-in-real-time instrument sound;

processing the music sequence data based on the topology information and the sound bank; and converting the processed music sequence data to sound.

37. The method of claim 36 comprising the further step of transmitting said musical work file by a CD drive.

38. The method of claim 36 comprising the further step of transmitting said musical work file by a network communications interface.

39. The method of claim 36 further comprising the step of mixing effects with the processed music sequence data.

40. The method of claim 39 wherein the topology information includes initial effect parameters for controlling the effects.

41. The method of claim 39 wherein the topology information further includes initial mix parameters for controlling the step of mixing.

42. The method of claim 36 wherein the music sequence data includes a work link specifying a location storing work link data; and further comprising the step of retrieving the work link data from the location specified by the work link.

43. The method of claim 36 further comprising the step of certifying rights of the player system to convert the processed music sequence to sound.

44. A player system that can receive and play downloadable-in-real-time musical data, comprising:

means for receiving a musical work file containing downloadable-in-real-time topology information, downloadable-in-real-time music sequence data, and a sound bank which includes at least one downloadable-in-real-time instrument sound;

means for processing the music sequence data based on the topology information and the sound bank; and means for converting the processed music sequence data to sound.

45. A computer-readable medium storing program code for causing a computer to perform the steps of:

receiving a musical work file containing downloadable-in-real-time topology information, downloadable-in-real-time music sequence data, and a sound bank which includes at least one downloadable-in-real-time instrument sound;

processing the music sequence data based on the topology information and the sound bank; and converting the processed music sequence data to sound.

* * * * *

US005886274C1

(12) EX PARTE REEXAMINATION CERTIFICATE (8027th)

United States Patent

Jungleib

(10) Number: US 5,886,274 C1

(45) Certificate Issued: Feb. 15, 2011

(54) SYSTEM AND METHOD FOR GENERATING, DISTRIBUTING, STORING AND PERFORMING MUSICAL WORK FILES

(75) Inventor: Stanley Jungleib, Portola Valley, CA (US)

(73) Assignee: Seer Systems, Inc., Los Altos, CA (US)

Reexamination Request:
No. 90/009,299, Oct. 8, 2008

Reexamination Certificate for:

| | |
|---|---|
| Patent No.: | **5,886,274** |
| Issued: | **Mar. 23, 1999** |
| Appl. No.: | **08/891,580** |
| Filed: | **Jul. 11, 1997** |

(51) Int. Cl.
*G10H 1/00* (2006.01)

(52) U.S. Cl. ..... 84/601

(58) Field of Classification Search ..... None
See application file for complete search history.

(56) References Cited

U.S. PATENT DOCUMENTS

| | | | |
|---|---|---|---|
| 5,054,360 | A | 10/1991 | Lisle et al. |
| 5,119,711 | A | 6/1992 | Bell et al. |
| 5,453,570 | A | 9/1995 | Umeda et al. |
| 5,484,291 | A | 1/1996 | Nakai et al. |
| 5,491,751 | A | 2/1996 | Paulson et al. |
| 5,521,323 | A | 5/1996 | Paulson et al. |
| 5,589,947 | A | 12/1996 | Sato et al. |
| 5,592,588 | A | 1/1997 | Reekes et al. |
| 5,629,980 | A | 5/1997 | Stefik et al. |
| 5,636,276 | A | 6/1997 | Brugger |
| 5,728,962 | A | 3/1998 | Goede |
| 5,734,119 | A | 3/1998 | France et al. |
| 5,736,663 | A | 4/1998 | Aoki et al. |
| 5,751,281 | A | 5/1998 | Hoddie et al. |
| 5,763,800 | A | 6/1998 | Rossum et al. |
| 5,768,396 | A | 6/1998 | Sone |
| 5,811,706 | A | 9/1998 | Van Buskirk et al. |
| 5,953,005 | A | 9/1999 | Liu |
| 6,098,126 | A | 8/2000 | Batson et al. |

OTHER PUBLICATIONS

Stanley Jungleib, General MIDI (A–R Editions, Inc. Madison, WI (1995)).
Richard Heimlich et al., Sound Blaster: The Official Book (McGraw–Hill, Inc., Berkeley, CA (1993)).
Thomas Levergood et al., AudioFile: A Network–Transparent System for Distributed Audio Applications, Summer USENIX, Cincinnati, OH, Jun. 21–25, 1993, at pp. 219–236.
White, "MIDI Basics," Sound on Sound (Aug.–Dec. 1995).
Wilkinson, "The Secret World of System Exclusive," Electronic Musician (Feb. 1993).
Rona, "The MIDI Companion," Hal Leonard Corp. 1994.
Lehman & Tully, "MIDI for the Professional," Amsco Publications 1993.
Rothstein, "MIDI: A Comprehensive Introduction," A–R Editions, Inc. (2d Ed. 1995).
Rumsey, "MIDI Systems and Control," Focal Press, 1994.
Yamaha Music Synthesizer : W5/W7 Owner's Manua, 1994.
Tracy, Tom et al., "Ensoniq Advanced Music Sampling Recorder Musician's Manual, V. 1.5," (Ensoniq 1992).

(Continued)

*Primary Examiner*—Deandra M Hughes

(57) ABSTRACT

A composition and playback system includes a sound bank containing at least one instrument sound, an input device for receiving music control signals, a sequencer coupled to the input device for storing the music control signals, and a work manager coupled to the sound bank and to the sequencer for generating a musical work file containing the music control signals and at least a portion of the sound bank. The system further includes a synthesizer engine coupled to the input device for processing the music control signals based on the instrument sounds contained in the sound bank, a mixer coupled to the synthesizer engine for mixing effects with the processed music control signals, and a speaker system coupled to the mixer for converting the mixed music control signals to sound.

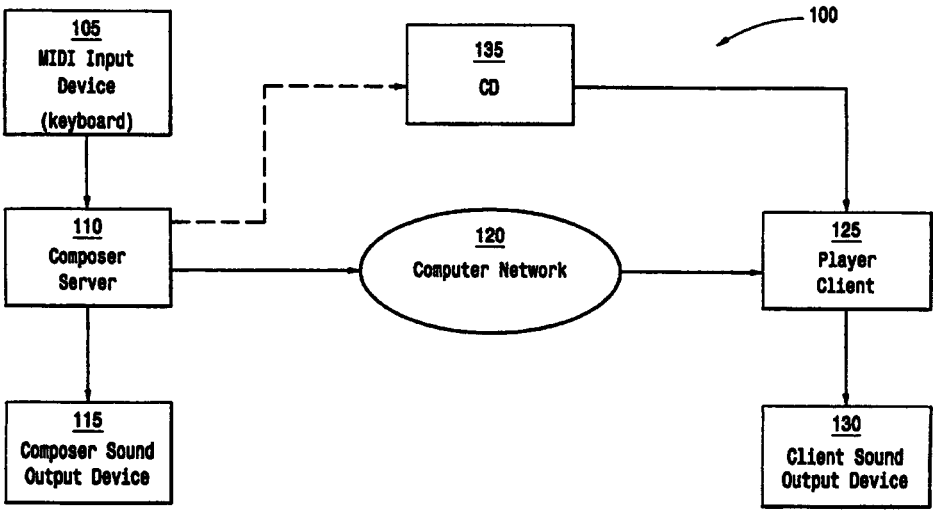

OTHER PUBLICATIONS

Heimlich, Richard et al., "Sound Blaster, The Official Book," (Osborne McGraw–Hill, 1993).
Jungleib, Stanley, "General MIDI," (A–R Editions, Inc. 1995).
Pope, Steven T, et al., "Machine Tongues XVIII: A Child's Garden of Sound File Formats," 19 Computer Music Journal 1 (Spring 1995).
Heckroth, Jim, "Tutoiral on MIDI Synthesis," (MIDI Manufacturers Assocation, 1995).
Kaplowitz, David et al., "MIDI Rocks the Web," Music & Computers, Mar./Apr. 1994, p. 28–30.
MIDI Manufacturers Association, "Standard MIDI Files 1.0," (MIDI Manufacturers Association, Feb. 1996).
MIDI Manufacturers Association, "MIDI 1.0 Detailed Specification," (MIDI Manufacturers Association, Feb. 1996).
MIDI Manufacturers Association, "Downloadable Sounds Level 1, Version .99d," (MIDI Manufacturers Association, Nov. 25, 1996).
Scheirer, Eric D. et al., "Synthetic Audio Specification Proposal for SNHC Audio," ISO/IEC JTC1/SC29/WG11 M1788 (Feb. 1997).
Evans, Maff, "Eight to the Bar," 29 Amiga Format, Dec. 1991, p. 143–46 and Coverdisk.
Amiga Computing, "The Disk: The Amazing MED v.3.00," May 1991, p. 34–38 and Coverdisk.
CU Amiga Magazine, Disk 132, May 1996, p. 9–10 and Coverdisk.
"Yamaha Mid–Term Selection," Sound on Sound (Dec. 1994).
"Yamaha W7," Sound on Sound (Jan. 1995).
Yamaha W5/W7 Technical Information (1994).
Yamaha W5/W7 System Upgrade Information (1995).
Hales, "MIDI Player 2.0 Manual," (Igor's Software Laboratories, Jul. 24, 1996).
Hales, "SoundMusicSys Musician's and Programmer's Technical Documentation," (Igor's Software Laboratories, Sep. 1, 1995).
Hales, "SoundMusicSys Musician's and Programmer's Technical Documentation." (Igor's Software Laboratories Jun. 7, 1996).
Essex, Jeff, "Creating MIDI for the Web," Sponsored by the Apple Computer, Inc. Worldwide Development Relations Group, 1996.
"Jam Session Manual," Bogas Productions, 1992.
"Super Studio Session," Bogas Productions, 1991.
"Quicktime Readme," Apple Computer, Inc., Jul. 24, 1996.
VanBrink, David, "Music the Easy Way: The QuickTime Music Architecture," The Apple Technical Journal, Sep. 1995.
Olson, Kip, "Sound Secrets," The Apple Technical Journal, Dec. 1995.
Olson, Kip, "Make Your Own Sound Components," The Apple Technical Journal, Dec. 1994.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 3 is confirmed.

Claims 9-10 and 14 are cancelled.

Claims 1, 8, 11, 15-16, 22, 25-28, 32, 34-36 and 42-45 are determined to be patentable as amended.

Claims 2-7, 12, 13, 17-21, 23-24, 29-31, 33 and 37-41, dependent on an amended claim, are determined to be patentable.

New claims 46-51 are added and determined to be patentable.

1. A composition system comprising:

a sound bank containing at least one instrument sound;

an input device for receiving music control signals, *wherein the music control signals include a work link specifying a location storing work link data that is downloadable in real time*;

a sequencer coupled to the input device for storing the music control signals; and a work manager coupled to the sound bank and to the sequencer for generating a musical work file containing the music control signals and at least a portion of the sound bank, *wherein the work manager includes a data I/O engine for storing the at least a portion of the sound bank and the music control signals into the musical work file, and the data I/O engine further stores the work link to the musical work file*.

8. [The] *A* composition system [of claim 1] *comprising:*

*a sound bank containing at least one instrument sound;*

*an input device for receiving music control signals;*

*a sequencer coupled to the input device for storing the music control signals; and*

*a work manager coupled to the sound bank and to the sequencer for generating a musical work file containing the music control signals and at least a portion of the sound bank,* wherein the work manager includes a work certifier for certifying the musical work file.

11. The composition system of claim [9] *1*, wherein the music control signals *further* include a music sequence, mix changes and effect changes; and the data I/O engine further stores the music sequence, the mix changes and effect changes to the musical work file.

15. [The] *A* composition system [of claim 14] *comprising:*

*a sound bank containing at least one instrument sound;*

*an input device for receiving music control signals,* wherein the music control signals include a work link specifying a location storing work link data *that is downloadable in real time;*

*a sequencer coupled to the input device for storing the music control signals; and*

*a work manager coupled to the sound bank and to the sequencer for generating a musical work file containing the music control signals and at least a portion of the sound bank, wherein the work manager includes a data I/O engine for storing the at least a portion of the sound bank and the music control signals into the musical work file, and wherein* the data I/O engine further [store] *stores* the work link to the musical file; [and]

*a synthesizer engine coupled to the input device for processing the music control signals based on the instrument sounds contained in the sound bank, and wherein* the synthesizer engine retrieves the work link data stored at the location specified by the work link*;*

*a mixer coupled to the synthesizer engine for mixing effects with the processed music control signals; and*

*a speaker system coupled to the mixer for converting the mixed music control signals to sound.*

16. A method comprising the steps of:

receiving music control signals*, wherein the music control signals include:*

*a music sequence, mix change and effect changes, and*

*a work link specifying a location storing work link data that is downloadable in real time;* receiving at least a portion of a sound bank containing at least one instrument sound; [and]

storing the music control signals and received sound bank portion as a musical work file*;*

*storing the music sequence, the mix changes, and the effect changes to the musical work file;*

*storing the work link to the musical work file; and*

*certifying the musical work file*.

22. [The] *A* method [of claim 16 further comprising the step of] *comprising the steps of:*

*receiving music control signals;*

*receiving at least a portion of a sound bank containing at least one instrument sound;*

*storing the music control signals and received sound bank portion as a musical work file; and*

[further comprising the step of] certifying the musical work file.

25. The method of claim 16 further comprising the steps of*:* processing the music control signals based on the instrument sounds contained in the sound bank;

mixing effects with the processed music control signals; and converting the mixed music control signals to sound.

26. A composition system comprising:

means for receiving music control signals*, wherein the music control signals include a work link specifying a location storing work link data that is downloadable in real time*;

means for receiving at least a portion of a sound bank containing at least one instrument sound; and means for storing the music control signals and received sound bank portion as a musical work file*, including the work link to the musical work file*.

27. A *non-transitory* computer-readable *storage* medium storing program code for causing a computer to perform the steps of:

receiving music control signals*, wherein the music control signals include a work link specifying a location storing work link data that is downloadable in real time*;

receiving at least a portion of a sound bank containing at least one instrument sound; and storing the music control signals and received sound bank portion as a musical work file.

28. A player system that can receive and play downloadable-in-real-time musical data, comprising:

an input terminal for receiving a musical work file containing downloadable-in-real-time topology information, downloadable-in-real-time music sequence data *including a work link specifying a location storing work link data*, and a sound bank which includes at least one downloadable-in-real-time instrument sound;

a synthesizer capable of adding downloadable-in-real-time sounds, said synthesizer being coupled to the input terminal for processing the music sequence data based on the topology information and the sound bank; and a speaker system coupled to the synthesizer for converting the processed music sequence data to sound.

32. The player system of claim 31 wherein the topology information *further* includes initial effect parameters for controlling the effects.

34. The player system of claim 31 wherein [the music sequence data includes a work link specifying a location storing work link data; and] the synthesizer engine retrieves the work link data referenced by the work link.

35. [The] *A* player system [of claim 28 further] *that can receive and play downloadable-in-real-time musical data,* comprising*:*

*an input terminal for receiving a musical work file containing downloadable-in-real-time topology information, downloadable-in-real-time music sequence data and a sound bank which includes at least one downloadable-in-real-time instrument sound;*

*a synthesizer capable of adding downloadable-in-real-time sounds, said synthesizer being coupled to the input terminal for processing the music sequence data based on the topology information and the sound bank;*

*a speaker system coupled to the synthesizer for converting the processed music sequence data to sound; and* a certifier for certifying rights of the player system to convert the processed music sequence to sound.

36. A method for playing a musical work file comprising the steps of:

receiving said musical work file containing downloadable-in-real-time topology information, downloadable-in-real-time music sequence data *including a work link specifying a location storing work link data*, and a sound bank which includes at least one downloadable-in-real-time instrument sound;

processing the music sequence data based on the topology information and the sound bank; and converting the processed music sequence data to sound.

42. [The] *A* method [of claim 36]** *for playing a musical work file comprising the steps of:*

*receiving said musical work file containing downloadable-in-real-time topology information, downloadable-in-real-time music sequence data and a sound bank which includes at least one downloadable-in-real-time instrument sound,* wherein the music sequence data includes a work link specifying a location storing work link data;

*processing the music sequence data based on the topology information and the sound bank;*

*converting the processed music sequence data to sound*; and [further comprising the step of]

retrieving the work linked data from the location specified by the work link.

43. [The] *A* method [of claim 36]** *for playing a musical work file comprising the steps of:*

*receiving said musical work file containing downloadable-in-real-time topology information, downloadable-in-real-time music sequence data and a sound bank which includes at least one downloadable-in-real-time instrument sound;*

*processing the music sequence data based on the topology information and the sound bank;*

*converting the processed music sequence data to sound; and* [further comprising the step of]

certifying rights of the player system to convert the processed music sequence to sound.

44. A player system that can receive and play downloadable-in-real-time musical data, comprising:

means for receiving a musical work file containing downloadable-in-real-time topology information, downloadable-in-real-time music sequence data *including a work link specifying a location storing work link data*, and a sound bank which includes at least one downloadable-in-real-time instrument sound;

means for processing the music sequence data based on the topology information and the sound bank; and means for converting the processed music sequence data to sound.

45. A *non-transitory* computer-readable *storage* medium storing program code for causing a computer to perform the steps of:

receiving a musical work file containing downloadable-in-real-time topology information, downloadable-in-real-time music sequence data *including a work link specifying a location storing work link data*, and a sound bank which includes at least one downloadable-in-real-time instrument sound;

processing the music sequence data based on the topology information and the sound bank; and converting the processed music sequence data to sound.

*46. The non-transitory computer-readable storage medium of claim 27, further storing program code for causing a computer to perform the steps of:*

*storing the work link to the musical work file; and*

*certifying the musical work file.*

*47. The player system of claim 30, wherein the network communications interface is configured for access to the Internet.*

*48. The method of claim 38, wherein the network communications interface is configured for access to the Internet.*

*49. A player system that can receive and play downloadable-in-real-time musical data, comprising:*

*an input terminal for receiving a musical work file containing downloadable-in-real-time topology information, downloadable-in-real-time music sequence data, and a sound bank which includes at least one downloadable-in-real-time instrument sound, wherein the music sequence data includes a work link specifying a location storing work link data;*

*a synthesizer capable of adding downloadable-in-real-time sounds, said synthesizer being coupled to the input terminal for processing the music sequence data based on the topology information and the sound bank, wherein the synthesizer retrieves the work link data referenced by the work link;*

*a mixer for mixing effects with the processed music sequence data; and*

*a speaker system coupled to the synthesizer for converting the processed music sequence data to sound.*

*50. A composition system comprising:*

*a sound bank containing at least one instrument sound;*

*an input device for receiving music control signals, wherein the music control signals includes a work link specifying a location storing work link data that is downloadable in real time;*

*a sequencer coupled to the input device for storing the music control signals; and*

*a work manager coupled to the sound bank and to the sequencer for generating a musical work file containing the music control signals and at least a portion of the sound bank, wherein the work manager includes a work certifier for certifying the musical work file.*

*51. A method for playing a musical work file comprising the steps of:*

*receiving said musical work file containing downloadable-in-real-time topology information, downloadable-in-real-time music sequence data, and a sound bank which includes at least one downloadable-in-real-time instrument sound, wherein the music sequence data includes a work link specifying a location storing work link data;*

*retrieving the work link data from the location specified by the work link;*

*processing the music sequence data based on the topology information and the sound bank; and*

*converting the processed music sequence data to sound.*

* * * * *